United States Patent [19]

Smith

[11] 4,077,168

[45] Mar. 7, 1978

[54] PREDECORATED GYPSUM WALLBOARD FOR IMPERMEABLE WALL

[75] Inventor: Richard E. Smith, Williamsville, N.Y.

[73] Assignee: National Gypsum Company, Buffalo, N.Y.

[21] Appl. No.: 762,877

[22] Filed: Jan. 27, 1977

[51] Int. Cl.[2] ..... E04C 2/00

[52] U.S. Cl. ..... 52/622; 52/243; 52/408; 428/464; 428/538

[58] Field of Search ..... 52/481, 458, 267, 515, 52/269, 622, 243, 615, 404, 309.8, 309.9, 241, 407, 268, 408, 309.15, 384; 428/538, 464, 449, 448, 457

[56] References Cited

U.S. PATENT DOCUMENTS

| | | | |
|---|---|---|---|
| 2,033,752 | 3/1936 | Billingham | 428/464 X |
| 3,312,585 | 4/1967 | Hamme | 428/538 X |
| 3,350,257 | 10/1967 | Hourigan et al. | 52/309.15 X |
| 3,654,067 | 4/1972 | Klein | 52/622 X |
| 3,733,231 | 5/1973 | Rutkowski et al. | 52/744 X |

*Primary Examiner*—Price C. Faw, Jr.
*Assistant Examiner*—Carl D. Friedman
*Attorney, Agent, or Firm*—Robert F. Hause

[57] ABSTRACT

An exterior wall or a roof-ceiling structure having, on the interior side, a wallboard with a front face which forms the interior wall or ceiling surface and a back face, which is adhered to wall framing members. The back face has a paper-foil laminate which is adhered to the basic board back side, with the foil side of the laminate adhered directly to the basic board back side. The paper side of the laminate is adhered directly to the wall framing members.

10 Claims, 1 Drawing Figure

PREDECORATED GYPSUM WALLBOARD FOR IMPERMEABLE WALL

Figure 1:
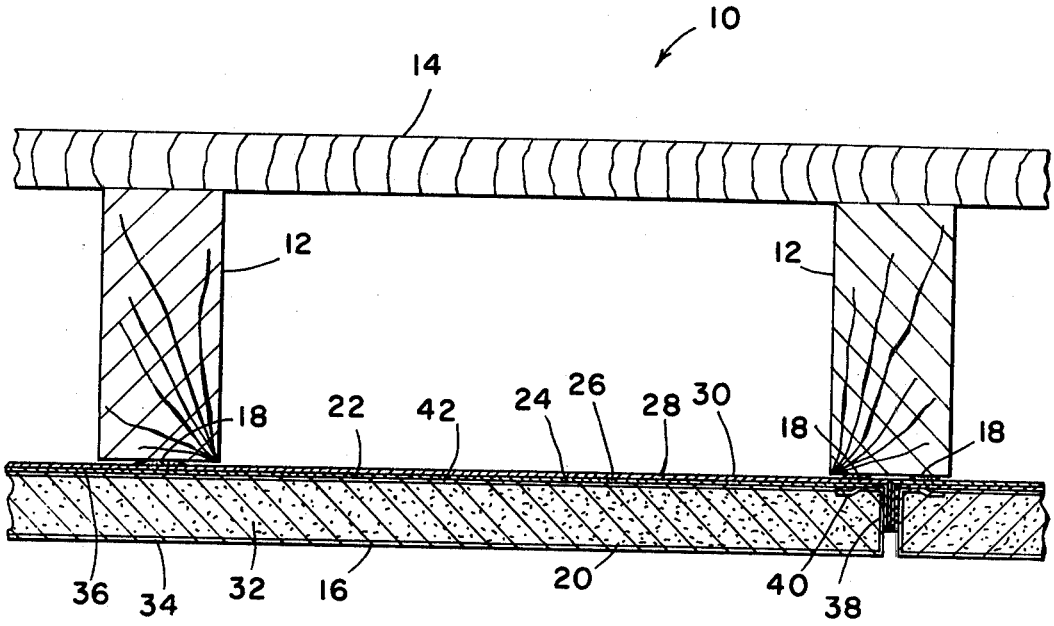

This invention relates to exterior wall construction and is particularly directed to wallboard forming the interior side of the exterior wall, having a paper-foil laminated to the back side of the basic wallboard with the foil side directed inwardly and the paper side adhered to wall framing members.

The inclusion of a vapor barrier in an exterior wall or in a roof-ceiling structure is a known practice. This has been accomplished in the past by various methods, such as the use of mineral fiber insulation batts or blankets in the wall cavity which are wrapped with foil on one face, or such as the use of large sheets of plastic film, for example polyethylene, affixed to the inner surfaces of the framing members and extending throughout the extent of the wall.

Another method of providing a vapor barrier has been the use of a presently available product referred to as foil-backed gypsum wallboard. Presently available foilbacked gypsum wallboard is a composite product consisting of a basic board with a foil-paper laminate which is laminated to the back side of the basic board, with the foil side of the foil-paper laminate exposed. Foil-backed gypsum wallboard has always had foil exposed on the back side whereby the foil can function as a reflective insulation. The foil of the prior foil-back gypsum wallboard was applied in the form of a paper-foil laminate, with the paper side being directed against the basic wallboard back side, providing a paper surface for the adhering of the laminate to the board.

This prior foil-back gypsum wallboard is not suitable for affixation to the wall framing members by an adhesive, because the foil surface does not bond sufficiently to a bead of adhesive disposed along the extent of the framing member face.

In accordance with the present invention, a novel gypsum wallboard-vapor barrier combination is prepared by adhering a foil-paper laminate onto a basic wallboard with the foil side of the laminate adhered to the basic wallboard with adhesive which is spread completely to bond the entire surface to the foil to the surface of the basic wallboard back side. This wallboard is adhered to framing members, such as studs or joists, with a bead of adhesive, which readily adheres to the very receptive paper side of the paper-foil laminate.

It is an object of the present invention to provide an improved wallboard for use as the interior surface of an exterior wall, having a vapor barrier on the back of the wallboard and a paper surface on the vapor barrier for reception of a wallboard application adhesive.

It is a further object of the invention to provide a novel wall structure formed by the adhesive application of such wallboard to the inner faces of the wall framing members.

These and other objects of the invention will be more fully apparent when considered in connection with the following detailed description of a preferred embodiment of the invention and the accompanying drawing in which FIG. 1 is a cross-sectional view of a wall embodying the present invention.

Referring to the drawing, there is shown a wall 10, which can be an exterior vertical wall or a roof-ceiling. Framing members 12, 12 can be either vertical studs or generally horizontal joists. On the exterior side of framing members 12, 12 is exterior facing material 14 which may be siding or roofing.

On the interior side of framing members 12, 12, there is adhered the novel composite vapor impermeable gypsum wallboard 16, with an elongate bead 18 of adhesive bonding each wallboard 16 to each framing member 12.

Each wallboard 16 is comprised of a basic board 20 plus a foil-paper laminate 22 adhered to the back face 24 of basic board 20. The foil-paper laminate 22 is comprised of aluminum foil 26 laminated to paper 28, with the paper 28 facing outwardly and thus forming the back face 30 of wallboard 16.

Basic board 20 is a basic form of commonly available gypsum board consisting of a gypsum core 32, a face paper liner 34 and a back paper liner 36. The face paper liner 34 extends around the edges 38 and onto the back of the board where it is overlapped at 40 by back paper liner 36.

The present invention is particularly adapted to the use of a form of basic board 20 having a predecorated face paper liner 34 which board is thus not suitable for screw application and is instead applied with adhesive. With paper 28 facing outwardly and forming the back face 30 of wallboard 16, the wallboard 16 can be affixed to framing members 12 with adhesive beads 18 with a resultant strong bond of the adhesive to the wallboard 16.

The foil-paper laminate 22 extends throughout the entire area of the wallboard back face 30, whereby the foil 26 forms a vapor barrier in wall 10. This foil 26, which would not function well as an outer surface for being bonded to framing members by beads of adhesive, does function completely satisfactorily as an inwardly directed side of the foil-paper laminate 22 in regard to being bonded firmly to the basic board back face 24, since this bonding function involves an adhesive being spread completely throughout the interface 42 between the foil 26 and the basic board back face 24.

The foil-paper laminate 22 is a standard commodity. In the preferred form of the invention, it has an overall thickness of 0.002 inch (0.005 cm), of which 0.00025 inch (0.00060 cm) is the thickness of the aluminum foil 26. The paper 28 is a 20 lb. Kraft paper. The weight of laminate 22 is about 11 lbs/thousand sq. ft. (54 kilograms/thousand square meters). For a typical wallboard 16 width of 48 inches (120 cm), the foil-paper laminate is $48\frac{1}{2}$ inches (121 cm) wide with about $\frac{1}{4}$ inch ($\frac{1}{2}$ cm) extending around onto each edge 38.

The aluminum foil 26 is completely bonded throughout to the paper 28 and should be free of pin holes, tears, wrinkles, cuts or any other type of surface imperfection. The foil-paper laminate 22, as described, can be obtained from Reynolds Metals Company or Aluminum Company of America. Foils other than aluminum, such as steel, or other impermeable films, such as plastic, can be used also.

A suitable adhesive for adhering the foil-paper laminate 22 to the basic board back face 24 is an aqueous solution of sodium silicate having a specific gravity of about 1.4.

In addition to the use of adhesive beads 18, the wallboards 16 of the invention can be adhered to framing members 12 by using an electrically activated hot melt strip disposed between wallboard 16 and framing members 12 as taught in U.S. Pat. No. 3,733,231.

Having completed a detailed disclosure of the preferred embodiments of the invention, so that others may practice the same, I contemplate that variations may be made without departing from the essence of the invention.

I claim:

1. A vapor impermeable wallboard suitable for being adhesively applied to framing comprising a basic board having a front face and a back face, said basic board having a laminate of paper and an air impermeable film adhered to said back face, with the air impermeable film side of said laminate adhered directly to said basic board back face, and said paper side of said laminate forming an adhesive-receptive back surface of said vapor impermeable wallboard.

2. The wallboard of claim 1 wherein said air impermeable film is a metal foil.

3. The wallboard of claim 2 wherein said basic board comprises a gypsum core, a back paper liner and a front paper liner, and wherein said foil-paper laminate is adhered to said back paper liner.

4. The wallboard of claim 3 wherein said foilpaper laminate is adhered to said back paper liner with an adhesive which is uniformly spread throughout the area of said laminate.

5. The wallboard of claim 1 wherein said laminate consists of paper and aluminum foil.

6. The wallboard of claim 5 wherein said aluminum foil has a thickness of about 0.00025 inch.

7. The wallboard of claim 5 wherein said paper is a 20 pound Kraft paper.

8. A vapor impermeable wall comprising framing members, and a plurality of wallboards as defined in claim 1, said wallboards being affixed to said framing members by adhesives bonded to said framing members and to the paper of said laminate.

9. A wall as defined in claim 8 wherein said wallboards comprise a basic board which is a paper-covered gypsum wallboard.

10. A wall as defined in claim 9 wherein said paper-covered gypsum wallboard has a predecorated front face paper which is undisturbed by the erection of said wallboard.

* * * * *